US010663256B1

(12) United States Patent
Garbouchian

(10) Patent No.: US 10,663,256 B1
(45) Date of Patent: May 26, 2020

(54) FIREARMS SIGHT

(71) Applicant: Vartan Frank Garbouchian, Fremont, NH (US)

(72) Inventor: Vartan Frank Garbouchian, Fremont, NH (US)

( * ) Notice: Subject to any disclaimer, the term of this patent is extended or adjusted under 35 U.S.C. 154(b) by 0 days.

(21) Appl. No.: 16/194,435

(22) Filed: Nov. 19, 2018

(51) Int. Cl.
*F41G 1/42* (2006.01)

(52) U.S. Cl.
CPC ..... *F41G 1/42* (2013.01); *F41G 1/425* (2013.01)

(58) Field of Classification Search
CPC ..... F41G 1/42; F41G 1/425
USPC ..... 42/113
See application file for complete search history.

(56) References Cited

U.S. PATENT DOCUMENTS

| | | | | |
|---|---|---|---|---|
| 1,256,987 | A | 2/1918 | Dittemore | |
| 1,260,907 | A | 3/1918 | Johnson et al. | |
| 2,382,631 | A | 8/1945 | Harasta | |
| 4,616,421 | A * | 10/1986 | Forsen | F41G 1/12 42/122 |
| 4,890,407 | A | 1/1990 | Nichols | |
| 5,519,941 | A | 5/1996 | Yusko | |
| 6,035,539 | A | 3/2000 | Hollenbach et al. | |
| 6,640,482 | B2 | 11/2003 | Carlson | |
| 7,171,776 | B2 | 2/2007 | Staley, III | |
| 7,921,591 | B1 | 4/2011 | Adcock | |
| 8,925,238 | B2 | 1/2015 | Anderson | |
| 9,303,952 | B2 | 4/2016 | Hakansson et al. | |
| 2008/0184609 | A1 * | 8/2008 | Schulst | F41G 1/08 42/111 |
| 2013/0219767 | A1 * | 8/2013 | Peterson | F41G 11/003 42/113 |

FOREIGN PATENT DOCUMENTS

| | | | | |
|---|---|---|---|---|
| CA | 1073202 A * | 3/1980 | | F41G 1/16 |
| DE | 2359833 A1 * | 7/1975 | | F41G 1/42 |
| DE | 3834924 | 4/1990 | | |
| GB | 570558 A * | 7/1945 | | F41G 1/42 |
| WO | 2011116541 | 9/2011 | | |
| WO | 2012121735 | 9/2012 | | |
| WO | 2018015096 | 1/2018 | | |

* cited by examiner

*Primary Examiner* — Bret Hayes
(74) *Attorney, Agent, or Firm* — Lambert Shortell & Connaughton; Gary E. Lambert; David J. Connaughton, Jr.

(57) ABSTRACT

A firearms sight is provided. The sight has a body having a rear aperture disc connected at one end, and a front sight disc connected at the opposite end. In use, a user may look through the rear aperture disc to align a marker of the front sight disc with an aperture of the rear aperture disc, the marker being visible through the rear aperture disc.

19 Claims, 4 Drawing Sheets

FIREARMS SIGHT

BACKGROUND OF THE INVENTION

Field of the Invention

The present invention relates generally to firearms sights. More particularly the present invention relates to sight which combines a front and rear sight into one unit.

Description of Related Art

Aiming of a firearm can be aided by the use of a sight, which is a device to visually align a barrel of the firearm to aim it at a target. Two examples of sights include open sights, and red dot sights. The former suffers from being cumbersome and slow to use, the latter requires battery power and utilizes electronics, making it susceptible to failure and breaking. Scopes may also be used, which provide magnification, but again these are also cumbersome to use and impractical in many applications.

Therefore, what is needed is a compact sight which provides advantages of both the open sights and red dot sights, without the drawbacks of either.

SUMMARY OF THE INVENTION

The subject matter of this application may involve, in some cases, interrelated products, alternative solutions to a particular problem, and/or a plurality of different uses of a single system or article.

In one aspect, a firearm sight is provided. The firearm sight has an elongate body. At one end of the elongate body, a rear aperture disc is connected. The rear aperture disc is transparent or translucent and contains an approximately concentric circular ring which defines an aperture on an inside of the ring. A front sight disc is connected to an opposite second end of the elongate body. The front sight disc has a colored marker (typically red) at an approximate center. The colored marker is viewable through the rear aperture disc when aligned. In another aspect, a firearm having this sight attached is provided.

DETAILED DESCRIPTION

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a front and rear sight combined in a single unit. The sight has a rear aperture and a front sight having a marker alignable with the aperture. The aperture and front sight are held in alignment with each other by a body which is, in most embodiments, formed as an open tube. This configuration is adjustable for elevation and windage, and can be connected, either directly or through adapters, to a firearm.

The rear aperture of the sight is connected or formed into a rear of the sight body. In most embodiments, the rear aperture is formed of a transparent disc, with a circular aperture (which may be an actual aperture, or may be filled with a transparent material). The aperture may be defined by a ring of material embedded in or on the disc, or may be marked onto a surface of the disc. Similarly, in most embodiments, the front sight is formed as a red (or similarly brightly colored) marker on a transparent disc. The marker may be a colored filament or other small item embedded in or on the disc in one embodiment, or a colored marking on a surface of the disc. In operation, a user aligns the front sight with the aperture to ensure proper aiming. Adjustments can be made in the connection of the sight to the firearm to ensure proper alignment.

Figure 1:
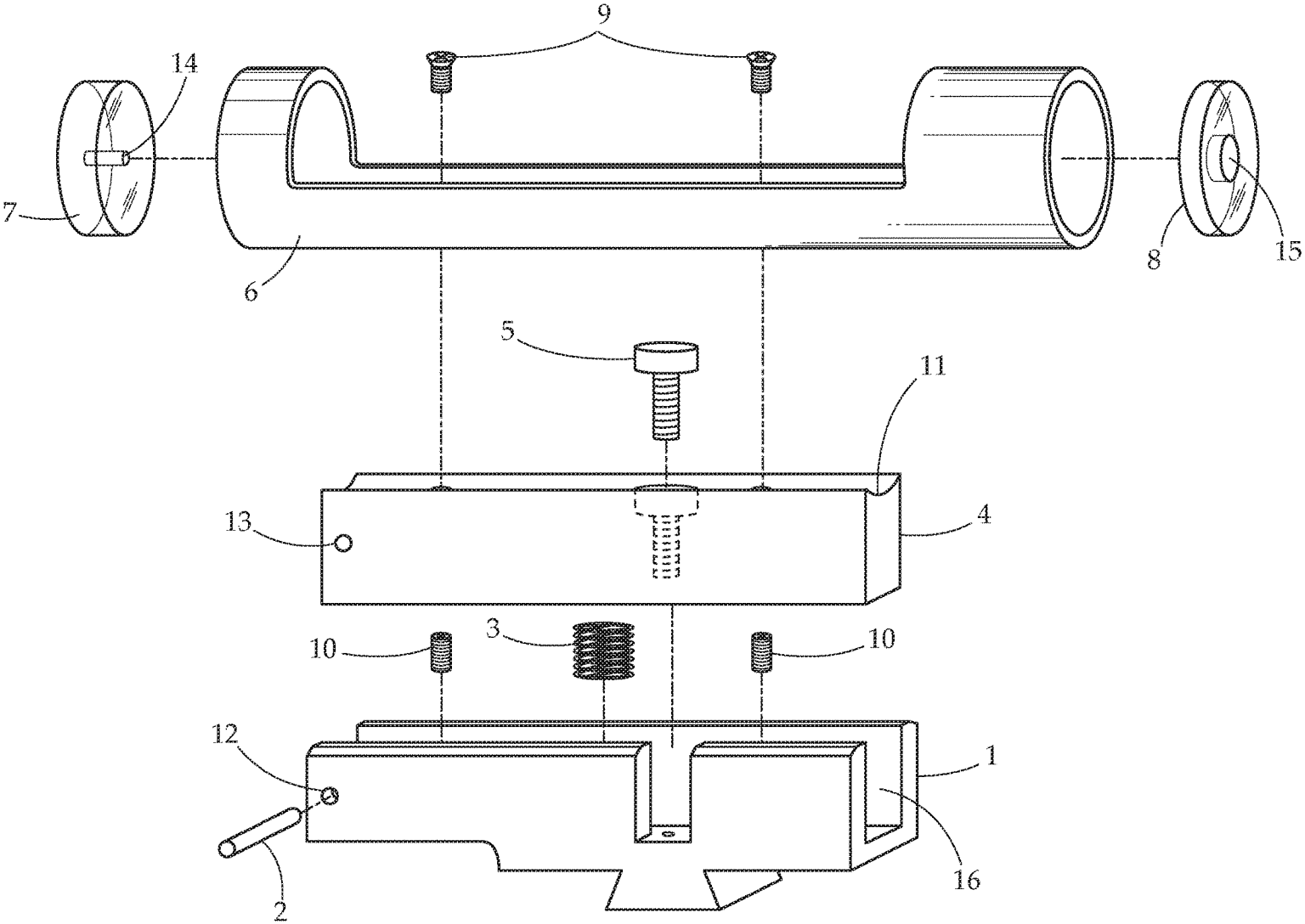
FIG. 1 provides an exploded view of an embodiment of the firearms sight.

Turning now to FIG. 1, an exploded view of an embodiment of the firearms sight is shown. In this view, the body 6 of the sight is formed as an open tube, meaning a tube which has a cutout portion, as shown. In such embodiments, light can enter the cutout portion as well as the front and rear of the tube. Other embodiments are also contemplated such as a simple base which connects to a bottom of a standalone front and rear sight. Put another way, the body 6 need not be an open tube. A rear aperture disc 8 connects to a rear of the body 6. The rear aperture disc 8 is formed of a transparent material. The aperture disc 8 defines an aperture 15, which may be an approximately circular opening or may be an approximately circular transparent material. The aperture 15 is defined by an opaque or translucent material, such as a dark plastic or metal ring. This ring is approximately concentric with a perimeter of the rear aperture disc 8 in most embodiments. A front sight disc 7 connects to a front of the body 6. The front sight disc 7 is formed of a transparent material having a colored marker 14 on or in it. In this view, the colored marker 14 is a colored filament, and is typically red. A red color naturally attracts the eye and provides contrast to other objects being viewed through the sight. In use, a user may align the sight so that the marker 14 is concentric with or within the aperture 15, ensuring that the firearm is pointed at its target.

Screws 9 allow connection of the body 6 to a base 4. The base 4 is shaped to receive the body 6 on a top surface, and shaped to fit to an adapter 1 allowing connection to various firearms. In this view, the base 4 has a curved recession 11 on its top surface to receive the curved body 6. The base 4 further has two threaded openings which allow connection of screws 9 through the body tube 6. Of course, other connection structures are contemplated herein and are within the scope of this invention. In the embodiment shown, the base 4 is adjustably connected to adapter 1 to allow for adjustment of the sight orientation. This allows accommodation for elevation, windage, and precise alignment on the firearm. Notably, in other embodiments, a similar adjustment configuration may be employed between the base 4 and body 6, instead of or in addition to an adjustable connection between base 4 and adapter 1.

A pin 2 passes through openings 12 of the adapter 1 and through opening 13 in the base. This allows for pivotal movement between the base and adapter about an axis defined by the pin 2. The base 4 can fit into a spacing 16 defined by the adapter 1. A spring 3 is positioned between the adapter 1 and a bottom surface of the base 4. The spring urges the adapter 1 and base 4 apart. An elevation adjuster screw 5 connects through the base 4 to a threaded hole in the adapter 1. The elevation adjuster screw 5 can be tightened to bring a rear of the base 4 downward closer to the adapter 1, or be loosened and, as urged by the spring, cause the rear of the base to rise upward. This can adjust the lengthwise orientation of the sight body 6 and in turn, alignment of the marker 14 relative to the aperture 15. In this view, set screws 10 allow connection of the adapter 10 to a firearm. A shape of the adapter 1 may be modified for connection to a particular firearm. In the present view, the adapter 1 has a dovetail connector which can connect to a corresponding shape in the firearm. This may vary depending on what type of firearm the adapter 1 is intended to connect to.

Figure 2:
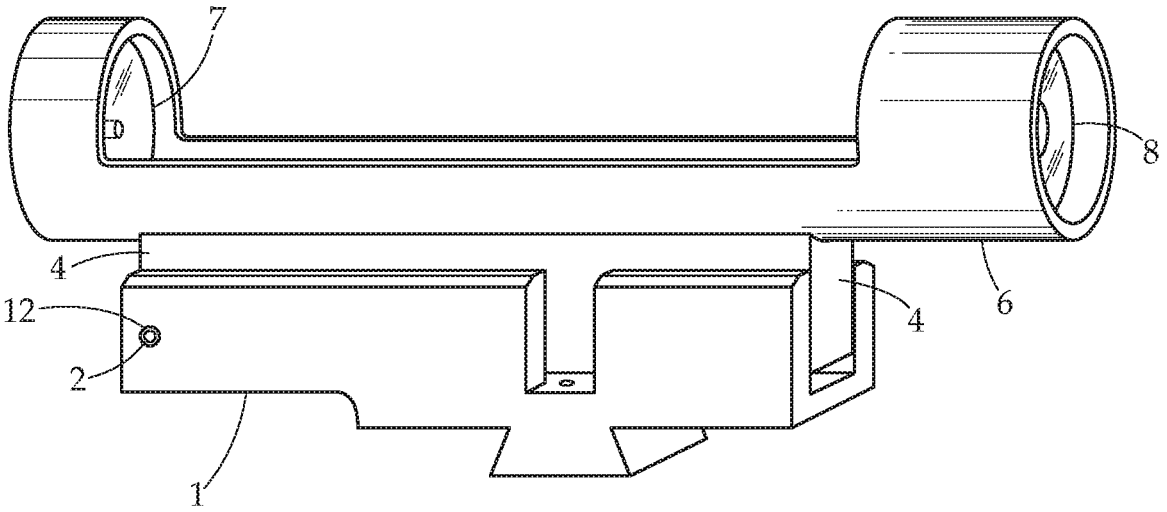
FIG. 2 provides a side view of another embodiment of the firearms sight.

FIG. 2 shows another embodiment of the firearms sight from a side view. The body 6 here is connected to the adapter 1 via the base 4. The body 6 defines circular regions at its front and rear in which the rear disc 8 and front disc 7 are held. The circular regions also provide a convenient and easy object for the firearms user to find and to align an eye to by looking through the circular region and discs 7, 8 held therein. Pin 2 is positioned in opening 12 to allow pivotal motion between the base 4 and adapter 1.

Figure 3:
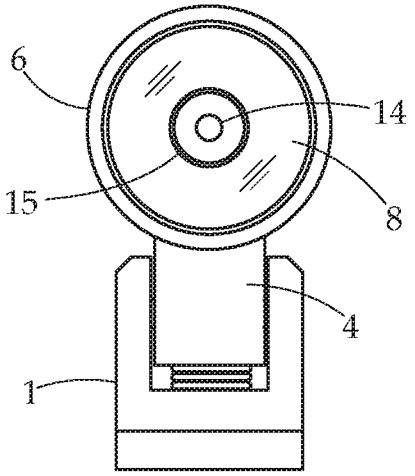
FIG. 3 provides a rear to front view of yet another embodiment of the firearms sight.

FIG. 3 shows a rear-to-front view of another embodiment of the firearms sight. Here, a view of the device in operation can be seen. Base 4 connects to the body 6. A rear aperture disc 8 is in the foreground and defines an aperture 15. Behind the rear aperture disc 8, the front sight disc 7 can be seen held in place by the body 6. The marker 14 is aligned approximately in the center of aperture 15. When the sight is connected to a firearm, such an alignment indicates that the firearm is aiming at whatever the marker 14 is pointing at.

Figure 4:
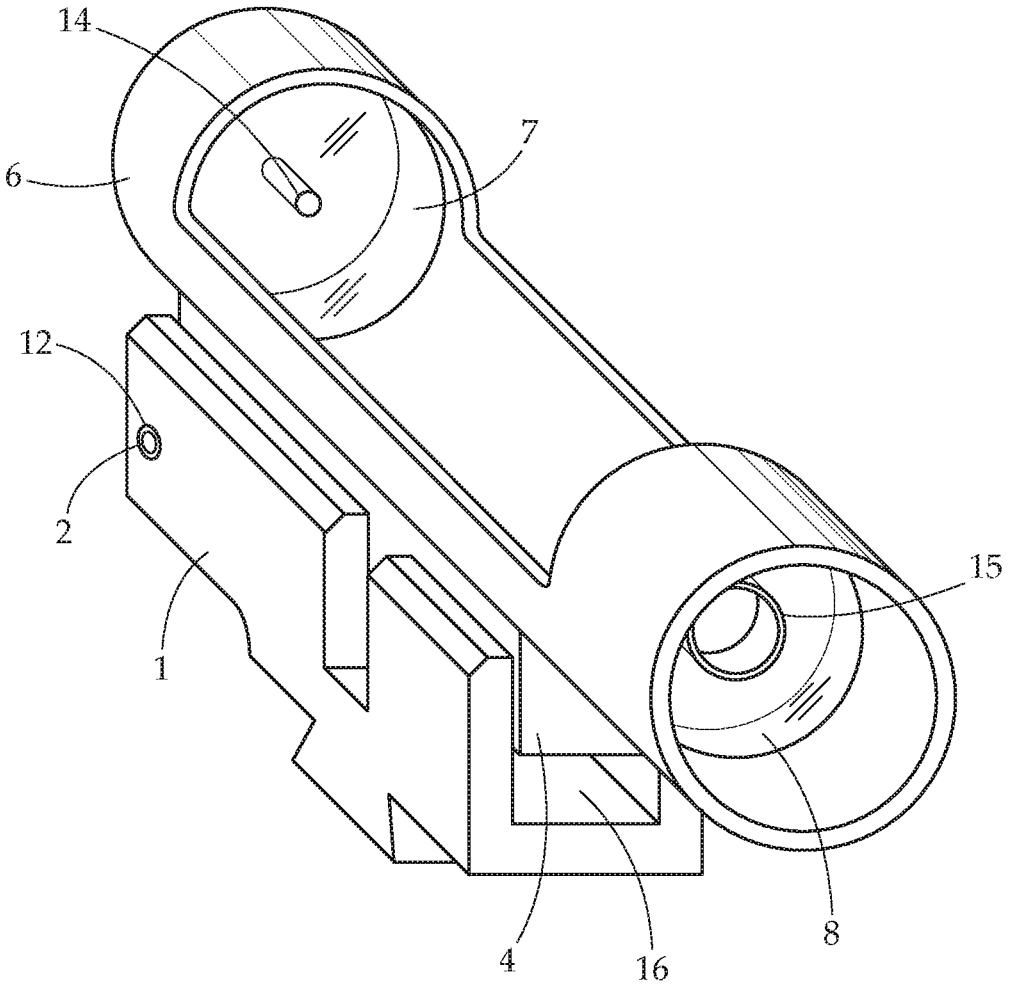
FIG. 4 provides a perspective view of still another embodiment of the firearms sight FIG. 5 provides a side view of an embodiment of the firearms sight connected to a firearm.

FIG. 4 provides a perspective view of yet another embodiment of the firearms sight. The body 6 holds a transparent rear aperture disc 8 which defines aperture 15 at a side which is intended to be installed closest to a shooter at a rear of the firearm. The body 6 also holds a transparent front sight disc 7 which has marker 14 at an approximate center of the front sight disc 7. Body 6 connects to base 4, which in turn is connected to adapter 1 by seating into the spacing 16 defined by the adapter 1.

Figure 5:
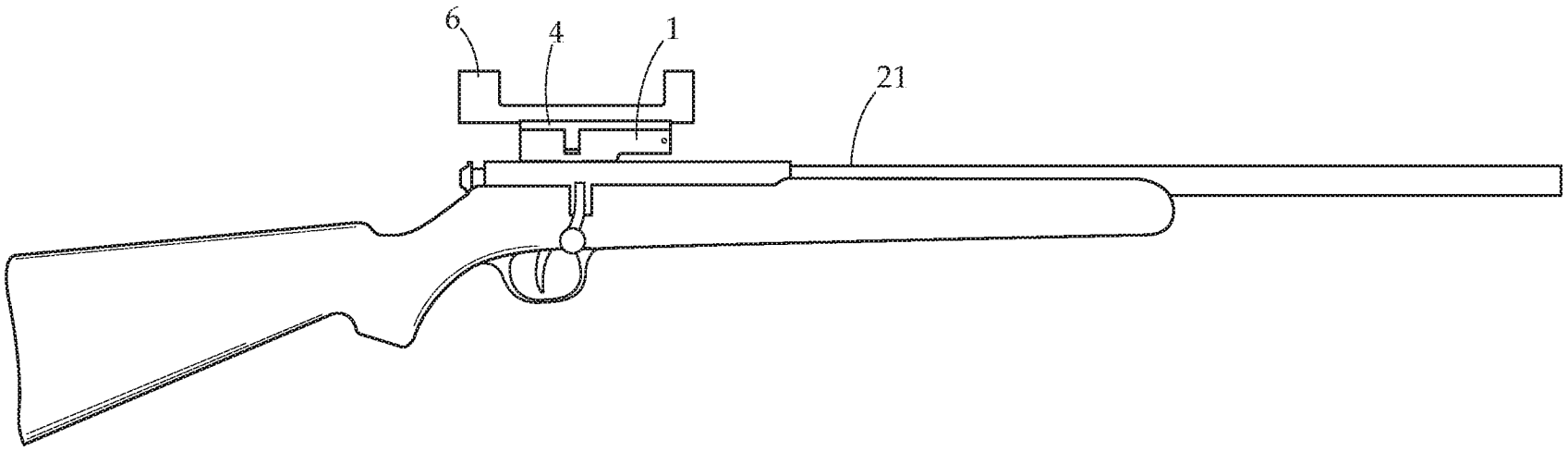

FIG. 5 shows an embodiment of the firearms sight attached to a firearm. As can be seen, the body is positioned such that the rear aperture disc 8 is closest to the shooter and rear of the firearm, while the front sight disc 7 is closest to the end of the firearm barrel. In use, a shooter looks through the sight, by looking through both rear aperture disc 8 and front sight disc 7, and aligns the front marking 14 and aperture 15. This ensures that the firearm is pointing at its target.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A firearm sight comprising:

an elongate body;

a rear aperture disc formed of a solid transparent material connected to a first end of the elongate body, the rear aperture disc comprising a ring being approximately concentric with the rear aperture disc; and a front sight disc_formed of a solid transparent material connected to a second opposite end of the elongate body, the front sight disc comprising a marker at an approximate center, the marker viewable through the rear aperture disc, the marker comprising a filament extending in a lengthwise direction at least partially through a thickness of the transparent material of the front sight disc parallel to a thickness of the disc; and wherein the body is cylindrical and has an opening along its length.

2. The firearm sight of claim 1 wherein the ring defines an aperture.

3. The firearm sight of claim 1 further comprising a base connected to the body.

4. The firearm sight of claim 3 further comprising an adapter connectable to a firearm removably connected to the base.

5. The firearm sight of claim 4 wherein the base is pivotally connected to the adapter.

6. The firearm sight of claim 5 further comprising a screw passing through the base and engaged with the base, and connecting to the adapter, the screw configured such that a rotation of the screw causes a pivoting change in orientation between the base and the adapter.

7. The firearm sight of claim 6 further comprising a spring between the base and the adapter, the spring providing a spring force against the base and the adapter.

8. The firearm sight of claim 1 wherein the ring is a circular marking on a surface of the rear aperture disc.

9. The firearm sight of claim 1 wherein the body defines an opening, the body surrounding a perimeter of the rear aperture disc and the rear aperture disc fitted within the opening.

10. The firearm sight of claim 1 wherein the body defines an opening, the body surrounding a perimeter of the front sight disc and the front sight disc fitted within the opening.

11. A firearm comprising a sight, the sight comprising:

an elongate body;

a rear aperture disc formed of a solid transparent material connected to a first end of the elongate body, the rear aperture disc comprising a ring being approximately concentric with the rear aperture disc; and a front sight disc formed of a solid transparent material connected to a second opposite end of the elongate body, the front sight disc comprising a marker at an approximate center, the marker viewable through the rear aperture disc; and wherein the body is cylindrical and has an opening along its length.

12. The firearm of claim 11 wherein the ring defines an aperture.

13. The firearm of claim 11 further comprising a base connected to the body of the firearm sight.

14. The firearm of claim 13 further comprising an adapter connected the firearm and removably connected to the base.

15. The firearm of claim 14 wherein the adapter is pivotally connected to the base, and further comprising a screw passing through the base and engaged with the base, and connecting to the adapter, the screw configured such that a rotation of the screw causes a pivoting change in orientation between the base and the adapter.

16. The firearm of claim 15 further comprising a spring between the base and the adapter, the spring providing a spring force against the base and the adapter.

17. The firearm of claim 11 wherein the body defines a first opening, the body surrounding a perimeter of the rear aperture disc and the rear aperture disc fitted within the first opening; and wherein the body defines a second opening at an opposite side of the body from the first opening, the body surrounding a perimeter of the front sight disc and the front sight disc fitted within the second opening.

18. The firearm of claim 11 wherein the marker comprising a filament extending in a lengthwise direction at least partially through a thickness of the transparent material of the front sight disc parallel to a thickness of the disc.

19. A firearm sight comprising:

an elongate body;

a rear aperture disc formed of a solid transparent material connected to a first end of the elongate body, the rear aperture disc comprising a ring being approximately concentric with the rear aperture disc; and a front sight disc formed of a solid transparent material connected to a second opposite end of the elongate body, the front sight disc comprising a marker at an approximate center, the marker viewable through the rear aperture disc, the marker comprising a filament extending in a lengthwise direction at least partially through a thickness of the transparent material of the front sight disc parallel to a thickness of the disc;

an adapter connectable to a firearm removably connected to a base wherein the base is pivotally connected to the adapter.

* * * * *